US010841991B2

(12) United States Patent
Song

(10) Patent No.: US 10,841,991 B2
(45) Date of Patent: Nov. 17, 2020

(54) DIMMER INTERFACE HAVING REDUCED POWER CONSUMPTION

(71) Applicant: Lumileds LLC, San Jose, CA (US)

(72) Inventor: Zhi Hua Song, San Jose, CA (US)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/664,304

(22) Filed: Oct. 25, 2019

(65) Prior Publication Data

US 2020/0060002 A1 Feb. 20, 2020

Related U.S. Application Data

(62) Division of application No. 15/849,176, filed on Dec. 20, 2017, now Pat. No. 10,462,863.

(51) Int. Cl.

| | |
|---|---|
| ***H05B 45/10*** | (2020.01) |
| ***H05B 47/10*** | (2020.01) |
| *H05B 47/11* | (2020.01) |
| *H05B 47/19* | (2020.01) |

(52) U.S. Cl.

CPC ..... *H05B 45/10* (2020.01); *H05B 47/11* (2020.01); *H05B 47/19* (2020.01)

(58) Field of Classification Search

None

See application file for complete search history.

(56) References Cited

U.S. PATENT DOCUMENTS

| | | | | |
|---|---|---|---|---|
| 2006/0119321 | A1 | 6/2006 | Wang et al. | |
| 2012/0025733 | A1 | 2/2012 | Melanson | |
| 2012/0153835 | A1 | 6/2012 | Su et al. | |
| 2012/0153866 | A1 | 6/2012 | Liu | |
| 2012/0268030 | A1 | 10/2012 | Riesebosch | |
| 2013/0099694 | A1* | 4/2013 | Naruo | H05B 45/3725 315/224 |
| 2013/0250627 | A1 | 9/2013 | Herfurth | |
| 2013/0300310 | A1 | 11/2013 | Hu | |
| 2013/0320883 | A1 | 12/2013 | Zheng | |
| 2014/0159616 | A1* | 6/2014 | Wang | H05B 33/0848 315/307 |
| 2014/0265916 | A1 | 9/2014 | Melanson et al. | |
| 2015/0173145 | A1* | 6/2015 | Lee | H05B 33/0815 315/200 R |
| 2016/0088697 | A1 | 3/2016 | Yan et al. | |
| 2016/0323945 | A1 | 11/2016 | Bandel | |

OTHER PUBLICATIONS

Non Final Office Action in U.S. Appl. No. 15/849,176 dated Apr. 19, 2018, 13 pages.

Notice of Allowance in U.S. Appl. No. 15/849,176 dated Feb. 26, 2019, 11 pages.

Notice of Allowance in U.S. Appl. No. 15/849,176 dated Jun. 25, 2019, 11 pages.

* cited by examiner

*Primary Examiner* — Henry Luong

(74) *Attorney, Agent, or Firm* — Patent Capital Group

(57) ABSTRACT

Methods of operating a dimmer switch interface are described. A method includes receiving a dimmer input voltage, providing a dimmer output signal based on the dimmer input voltage, and detecting a voltage level of the dimmer output signal. The voltage level of the dimmer output signal is compared with the threshold. A transformer is intermittently turned off when the voltage level of the dimmer output signal is below the threshold.

18 Claims, 7 Drawing Sheets

DIMMER INTERFACE HAVING REDUCED POWER CONSUMPTION

CROSS REFERENCE TO RELATED APPLICATION(S)

This application is a divisional of U.S. patent application Ser. No. 15/849,176, filed Dec. 20, 2017 which is incorporated by reference as if fully set forth.

FIELD

The present disclosure relates to illumination systems in general, and more particularly, to a dimmer interface having reduced power consumption.

BACKGROUND

Light emitting diodes ("LEDs") are commonly used as light sources in various applications. LEDs are more energy-efficient than traditional light sources, providing much higher energy conversion efficiency than incandescent lamps and fluorescent light, for example. Furthermore, LEDs radiate less heat into illuminated regions and afford a greater breadth of control over brightness, emission color and spectrum than traditional light sources. These characteristics make LEDs an excellent choice for various lighting applications ranging from indoor illumination to automotive lighting. Accordingly, the need exists for improved LED-based illumination systems that harness the advantages of LEDs to provide high-quality illumination.

SUMMARY

The present disclosure addresses this need. According to aspects of the disclosure, an illumination system is disclosed, comprising: a light fixture including a driver coupled to a light source; a dimmer switch; and a dimmer switch interface, including: (i) a transformer having a first winding that is magnetically coupled to a second winding, the first winding being electrically coupled to the dimmer switch, and the second winding being electrically coupled to the driver of the light fixture, and (ii) a current source configured to power the transformer with an intermittent alternating current when the current source is energized.

BRIEF DESCRIPTION OF THE DRAWINGS

The drawings described below are for illustration purposes only. The drawings are not intended to limit the scope of the present disclosure. Like reference characters shown in the figures designate the same parts in the various embodiments.

DETAILED DESCRIPTION

Figure 1:
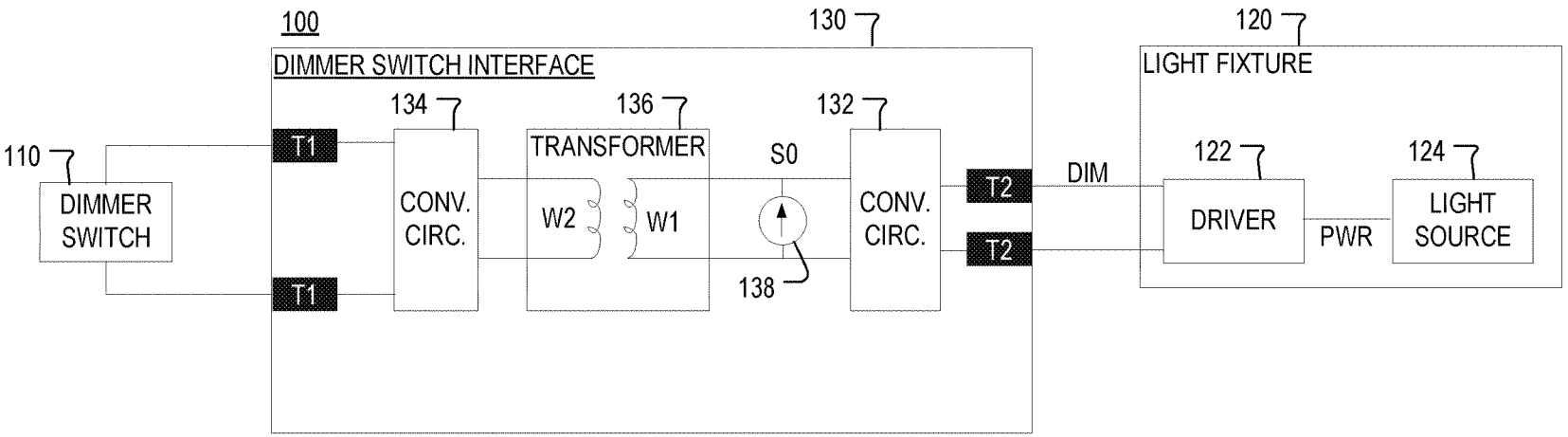
FIG. 1 is a schematic diagram of an example of an illumination system, according to aspects of the disclosure.

Dimmer switches are devices used to control the brightness of light produced by light fixtures. On the outside, a manually operated dimmer switch may appear as a knob which a user can turn to increase or decrease the brightness of a light fixture. On the inside, the dimmer switch may include a variable resistor that is coupled to the knob. The variable resistor may be used to adjust the value of a voltage signal that is provided by the dimmer switch to the light fixture.

One dimming system that is often used in fluorescent and LED lighting is called 0-10V dimming. According to this system, the voltage signal that is provided by a 0-10V dimming switch to a light fixture varies between 0V and 10V. When the value of the voltage signal is below a certain threshold close to 0V, the light fixture may operate at its lowest possible brightness or turn itself off completely. When the value of the voltage signal is above a certain threshold close to 10V, the light fixture may operate at its maximum brightness.

When the 0-10V system is used, dimmer switches are normally connected to light sources via dimmer switch interfaces. A dimmer switch interface is a device that may be interposed between a dimmer switch and a light fixture to electrically isolate the dimmer switch and suppress noise. To accomplish this function, the dimmer switch interface may include a transformer that is used to drive the dimmer switch and connect the dimmer switch to the light fixture.

One disadvantage of dimmer switch interfaces is that they are often energy-inefficient. A typical dimmer switch interface may often consume 100 mW or more, which consumption is mostly due to the transformer in the dimmer switch interface. This consumption may be undesirable as it may increase the cost of operating the dimmer switch interface. Furthermore, the power consumption due to the transformer in the dimmer switch interface may prevent a lighting system utilizing a dimmer switch interface from complying with various present and future environmental regulations that mandate limits on the standby power of lighting systems.

According to aspects of the disclosure, a dimmer switch interface is disclosed that has reduced power consumption. The dimmer switch interface may include a transformer that is used to magnetically couple a dimmer switch to a light fixture. The transformer may be driven by a current source configured to supply the transformer with an intermittent current. When the transformer is driven with intermittent current, the current supplied to the transformer is switched between a high current value (e.g., 10 mA) and low current value (e.g., 0A). During periods in which the intermittent current is switched to the low value (e.g., 0A), the transformer is turned off and does not consume any power. Accordingly, when the transformer is driven with intermittent current, the power consumption of the transformer can be significantly reduced.

According to aspects of the disclosure, a dimmer switch interface is disclosed, comprising: a pair of first terminals for connecting the dimmer switch interface to a dimmer switch; a pair of second terminals for connecting the dimmer switch to a driver of a light fixture; a transformer having a first winding that is magnetically coupled to a second winding, the first winding being electrically coupled to the pair of first terminals, and the second winding being electrically coupled to the pair of second terminals; and a current source configured to power the transformer with an intermittent alternating current when the current source is energized.

According to aspects of the disclosure, an apparatus is disclosed, comprising: a driver for a light fixture; and a dimmer switch interface for connecting the driver to a dimmer switch, the dimmer switch interface including: (i) a transformer having a first winding that is magnetically coupled to a second winding, the first winding being electrically coupled to a pair of terminals for connecting the dimmer switch interface to the dimmer switch, and the second winding being electrically coupled to the driver, and (ii) a current source configured to power the transformer with an intermittent alternating current when the current source is energized.

Examples of illumination systems will be described more fully hereinafter with reference to the accompanying drawings. These examples are not mutually exclusive, and features found in one example can be combined with features found in one or more other examples to achieve additional implementations. Accordingly, it will be understood that the examples shown in the accompanying drawings are provided for illustrative purposes only, and they are not intended to limit the disclosure in any way. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. It will be understood that these terms are intended to encompass different orientations of the element in addition to any orientation depicted in the figures.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

FIG. 1 is a diagram of an example of an illumination system 100, according to aspects of the disclosure. The illumination system 100 may include a dimmer switch 110, a light fixture 120, and a dimmer switch interface 130 coupling the dimmer switch 110 to the light fixture 120.

The dimmer switch 110 may be a 0-10V dimmer switch and/or any other suitable type of dimmer switch. The dimmer switch 110 may include a variable resistor (e.g., a potentiometer), and/or any suitable type of device that is capable of placing a variable load between terminals T1 of the dimmer switch interface 130. Additionally or alternatively, the dimmer switch 110 may include any suitable type of semiconductor device that is capable of changing the voltage between the terminals T1 of the dimmer switch interface 130. Stated succinctly, according to aspects of the disclosure, the dimmer switch 110 may be any suitable type of device that is capable of generating a voltage signal that indicates a desired level of brightness for the light output from the light fixture 120.

In some implementations, the dimmer switch 110 may include a light sensor that is configured to measure the level of ambient light in the vicinity of the light fixture 120 and generate a voltage signal based on the measured level of ambient light. Additionally or alternatively, in some implementations, the dimmer switch 110 may include a knob or a slider which can be used to actuate a potentiometer that is part of the dimmer switch 110. Additionally or alternatively, the dimmer switch 110 may include a wireless receiver (e.g., a ZigBee gateway, a WiFi receiver, a remote control receiver, etc.) that is capable of receiving an indication of a desired brightness level from a remote device (e.g., a user's smartphone or remote control) and generating a corresponding voltage signal based on the indication.

The light fixture 120 may include any suitable type of light fixture. The light fixture 120 may include a driver 122 and a light source 124 that is powered using a signal PWR. The light source 124 may include any suitable type of light source, such as a fluorescent light source, an incandescent light source, and/or one or more light emitting diodes (LEDs). In the present example, the light source 124 includes one or more LEDs and the signal PWR is a DC or a pulse-width modulated (PWM) signal that is generated by the driver 122 based on a signal DIM received by the driver 122 from the dimmer switch interface 130.

Signal DIM may be a voltage signal. The level of the signal DIM may determine the DC magnitude and/or the duty cycle of the signal PWR. If the signal DIM has a first level (e.g., 2V), the driver 122 may impart a first DC magnitude and/or a first duty cycle on the signal PWR. By contrast, if the signal DIM has a second level (e.g., 5V), the driver 122 may impart a second DC magnitude and/or a second duty cycle on the signal PWR that are different from those for the first DIM level. As can be readily appreciated, the DC magnitude and/or the duty cycle of the signal PWR determines the amount of current delivered to the light source 124, which in turn may determine the brightness of the light output from the light source 124.

Figure 2:
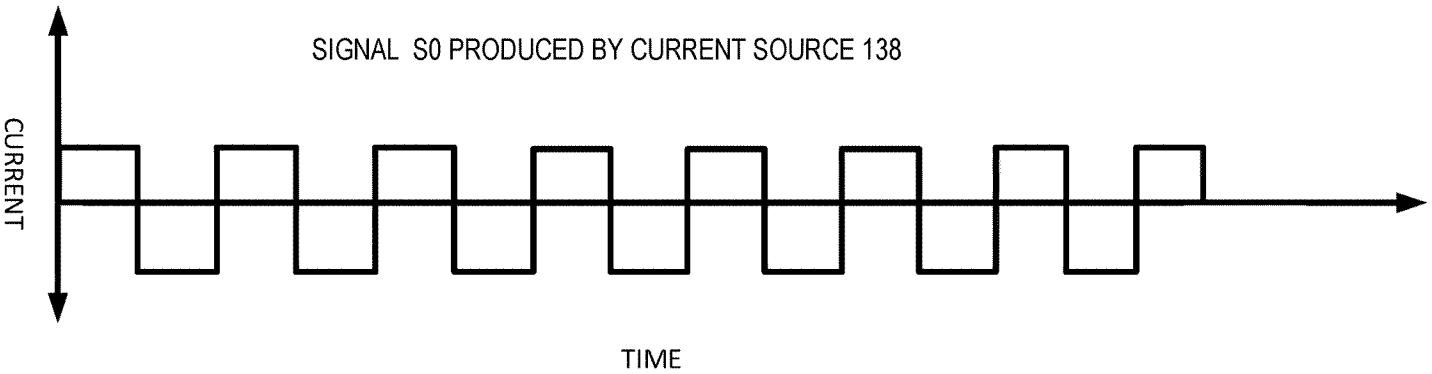
FIG. 2 is a graph of a current signal used to drive a transformer in a dimmer switch interface of the illumination system of FIG. 1, according to aspects of the disclosure.

The dimmer switch interface 130 may provide isolation between the light fixture 120 and the dimmer switch 110 mainly to protect human beings operating the dimmer switch from electrical shock. The dimmer switch interface 130 may include a converter circuit 132 that is coupled to a converter circuit 134 via a transformer 136. The transformer 136 may be driven with a continuous current signal S0 produced by a current source 138. As illustrated in FIG. 2, the signal S0 may be an alternating current (AC) signal, and it may be shaped as a continuous square wave. In alternative implementations, however, the signal S0 may be shaped as sinusoidal wave and/or any other suitable type of wave. In some implementations, a current signal may be continuous when the current signal has a constant current level.

The transformer 136 may include a winding W1 and a winding W2 that is magnetically coupled to the winding W1. The winding W1 may be electrically coupled to the light fixture 120 (e.g., via the converter circuit 132). The winding W2 may be electrically coupled to the dimmer switch 110 (e.g., via the converter circuit 134). In some implementations, the winding W2 may be electrically coupled to the terminals T1 of the dimmer switch interface 130 (e.g., via the converter circuit 134). In such instances, the dimmer switch 110 may be also coupled to the terminals T1 to complete the electrical connection between the dimmer switch 110 and the winding W2. Additionally or alternatively, in some implementations, the winding W1 may be electrically coupled to the terminals T2 of the dimmer switch interface 130 (e.g., via the converter circuit 132). In such instances, the driver 122 may also be coupled to the terminals T2 of the dimmer switch interface 130 to receive the signal DIM for controlling the brightness of the light source 124.

In operation, the winding W2 carries the dimming control information from the dimmer switch 110 via the converter circuit 134, which also converts the voltage across the winding W2 into a DC current to supply the dimmer switch 110. As noted above, the voltage across the winding W2 may be generated, at least in part, by the dimmer switch 110. Furthermore, the voltage across the winding W2 may be transferred to the winding W1 of the transformer 136 through magnetic coupling, and converted by the converter circuit 132 into a DC current to produce the voltage signal DIM. The voltage signal DIM may then be used by the driver 122 of the light fixture 120 to adjust the brightness of the light fixture 120. According to aspects of the disclosure, the converter circuit 132 may include any suitable electronic circuit that is configured to produce a DC signal based on an AC signal received from the winding W1. Furthermore, according to aspects of the disclosure, the converter circuit 134 may include any suitable electronic circuit that is configured to form a desired AC signal on the winding W2.

Figure 3:
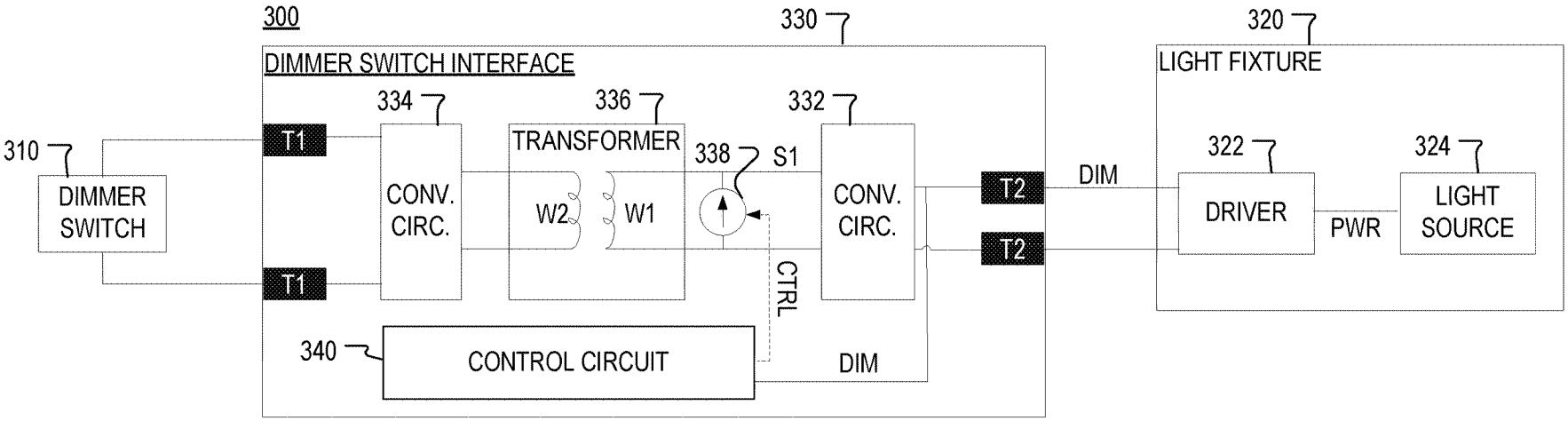
FIG. 3 is a schematic diagram of another example of an illumination system, according to aspects of the disclosure.

FIG. 3 is a diagram of an example of an illumination system 300 which has improved power consumption. As is discussed further below, the improved power consumption is achieved by using a current source that intermittently switches on and off the transformer in the system's dimmer switch interface in order to reduce the amount of power consumed to drive the transformer. According to the example of FIG. 3, the illumination system 300 may include a dimmer switch 310, a light fixture 120, and a dimmer switch interface 330 coupling the dimmer switch 310 to the light fixture 320.

The dimmer switch 310 may be a 0-10V dimmer switch and/or any other suitable type of dimmer switch. The dimmer switch 310 may include a variable resistor (e.g., a potentiometer), and or any suitable type of device that is capable of placing a variable load between terminals T1 of the dimmer switch interface 330. Additionally or alternatively, the dimmer switch 310 may include any suitable type of semiconductor device that is capable of changing the voltage between the terminals T1 of the dimmer switch interface 330. Stated succinctly, according to aspects of the disclosure, the dimmer switch 310 may be any suitable type of device that is capable of generating a voltage signal that indicates a desired level of brightness for the light output from the light fixture 320.

In some implementations, the dimmer switch 310 may include a light sensor that is configured to measure the level of ambient light in the vicinity of the light fixture 320 and generate a voltage signal based on the measured level of ambient light. Additionally or alternatively, in some implementations, the dimmer switch 310 may include a knob or a slider which can be used to actuate a potentiometer that is part of the dimmer switch 310. Additionally or alternatively, the dimmer switch 310 may include a wireless receiver (e.g., a ZigBee gateway, a WiFi receiver, a remote control receiver, etc.) that is capable of receiving an indication of a desired brightness level from a remote device (e.g., a user's smartphone or remote control) and generating a corresponding voltage signal based on the indication.

The light fixture 320 may include any suitable type of light fixture. The light fixture 320 may include a driver 322 and a light source 324 that is powered using a signal PWR. The light source 324 may include any suitable type of light source, such as a fluorescent light source, an incandescent light source, and/or one or more light emitting diodes (LEDs). In the present example, the light source 324 includes one or more LEDs and the signal PWR is a DC or a pulse-width modulated signal that is generated by the driver 322 based on a signal DIM received by the driver 322 from the dimmer switch interface 330.

Signal DIM may be a voltage signal. The level of the signal DIM may determine the DC magnitude and/or the duty cycle of the signal PWR. If the signal DIM has a first level (e.g., 2V), the driver 322 may impart a first DC magnitude and/or a first duty cycle on the signal PWR. By contrast, if the signal DIM has a second level (e.g., 5V), the driver 322 may impart a second DC magnitude and/or a second duty cycle on the signal PWR that are different from those for the first DIM level. As can be readily appreciated, the DC magnitude and/or the duty cycle of the signal PWR determines the amount of current delivered to the light source 324, which in turn may determine the brightness of the light output from the light source 324.

The dimmer switch interface 330 may provide isolation between the light fixture 320 and the dimmer switch 310 mainly to protect human beings operating the dimmer switch from electrical shock. The dimmer switch interface 330 may include a converter circuit 332 that is coupled to a converter circuit 334 via a transformer 336. The transformer 336 may be driven with an intermittent current signal S1 produced by a current source 338. The operation of the current source 338 and the waveform of the intermittent current signal S1 are discussed in additional detail further below.

The transformer 336 may include a winding W1 and a winding W2 that is magnetically coupled to the winding W1. The winding W1 may be electrically coupled to the light fixture 320 (e.g., via the converter circuit 332). The winding W2 may be electrically coupled to the dimmer switch 310 (e.g., via the converter circuit 334). In some implementations, the winding W2 may be electrically coupled to the terminals T1 of the dimmer switch interface 330 (e.g., via the converter circuit 334). In such instances, the dimmer switch 310 may be also coupled to the terminals T1 to complete the electrical connection between the dimmer switch 310 and the winding W2. Additionally or alternatively, in some implementations, the winding W1 may be electrically coupled to the terminals T2 of the dimmer switch interface 330 (e.g., via the converter circuit 332). In such instances, the driver 322 may also be coupled to the terminals T2 of the dimmer switch interface 330 to receive the signal DIM for controlling the brightness of the light source 324.

In operation, the winding W2 carries the dimming control information from the dimmer switch 310 via the converter circuit 334, which also converts the voltage across the winding W2 into a DC current to supply the dimmer switch 310. As noted above, the voltage across the winding W2 may be generated, at least in part, by the dimmer switch 310. Furthermore, the voltage across the winding W2 may be transferred to the winding W1 of the transformer 336 through magnetic coupling, and converted by the converter circuit 332 into the voltage signal DIM. The voltage signal DIM may then be used by the driver 322 of the light fixture 320 to adjust the brightness of the light fixture 320. According to aspects of the disclosure, the converter circuit 332 may include any suitable electronic circuit that is configured to produce a DC signal based on an AC signal received from the winding W1. Furthermore, according to aspects of the disclosure, the converter circuit 334 may include any suitable electronic circuit that is configured to form a desired AC signal on the winding W2.

Figure 4:
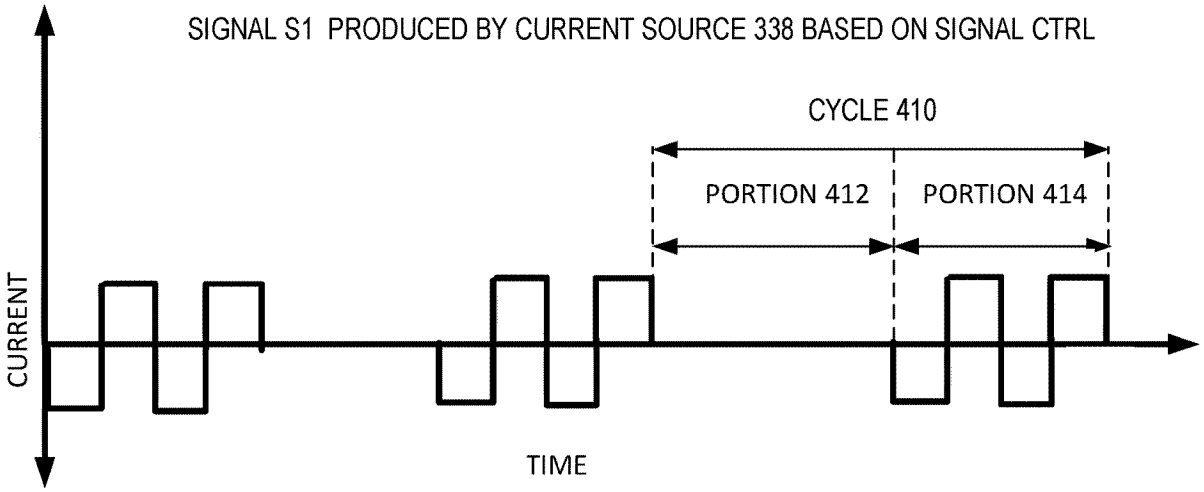
FIG. 4 is a graph of a current signal used to drive a transformer in a dimmer switch interface of the illumination system of FIG. 3, according to aspects of the disclosure.

As noted above, the current source 338 may power the transformer 336 with an intermittent current signal S1. The signal S1 may be an alternating current signal. As illustrated in FIG. 4, the signal S1 may be cyclical in nature. Each cycle 410 of the signal S1 may include a portion 412 during which the signal S1 has a first current level, and a portion 414 during which the signal S1 has a second current level. The second current level may be higher than the first current level. For example, in some implementations, the first current level may be OA and the second current level may have any value that is greater than OA.

The frequency at which the signal S1 is switched to the second current level may be referred to as burst frequency. In some implementations, the signal S1 may have a burst frequency of 1 Hz. However, alternative implementations are possible in which the signal S1 has any suitable frequency (e.g, 5 Hz, 10 Hz, 0.5 Hz, etc.)

When the signal S1 is at the first current level, the transformer 336 may be switched off (or operating in a reduced power consumption mode). When the signal S1 is at the second current level, the transformer 336 may be switched on and/or operating in a normal power consumption mode. In some implementations, by driving the transformer 336 with an intermittent current signal, the current source 338 may intermittently switch on and off the transformer 336. This in turn may cause the transformer 336 to be powered for only a fraction of the time for which the dimmer switch interface 330 is energized (or used), resulting in a reduced power consumption.

In some implementations, the signal S1 may be a PWM signal that is generated by intermittently changing its duty cycle. For example, during the portion 412 of each cycle 410, the current source 338 may switch the duty cycle of the signal S1 to a first value (e.g., 0%). As another example, during the portion 414 of each cycle 410, the current source 338 may switch the duty cycle of the signal S1 to a second value that is greater than the first value (e.g., 50%).

The duration of each cycle 410 of the signal S1 may determine the response time of the dimmer switch 310. As noted above, in some implementations, the duration of each cycle 410 may be 1 second. In such instances, the duration of each portion 412 of the cycle 410 may be 900 ms, and the duration of each portion 414 of the cycle 410 may be 100 ms. Alternatively, in some implementations, the duration of each portion 412 may be 980 ms and the duration of each portion 414 may be 20 ms. Stated succinctly, the present disclosure is not limited to any specific duration for the portions 412 and 414 and/or the cycle 410.

In some implementations, the signal S1 may be generated based on a control signal CTRL that is supplied to the current source 338 by a control circuit 340. The control circuit 340 may include any suitable type of control circuit. For example, in some implementations, the control circuit may be a square wave generator and/or another type of signal generator. Additionally or alternatively, in some implementations, the control circuit 340 may be a low-power processor and/or a general purpose processor (e.g., an ARM-based processor) capable of executing logical operations, such as comparisons and branches. Additionally or alternatively, in some implementations, the control circuit 340 may include a Field-Programmable Gate Array (FPGA) or an Application-Specific Integrated Circuit (ASIC). Additionally or alternatively, in some implementations, the control circuit 340 may be configured to execute one or more processor-executable instructions which when executed by the control circuit 340 cause the control circuit 340 to perform the process 700, which is discussed further below with respect to FIG. 7. The processor-executable instructions may be stored in a memory (not shown) that is part of the dimmer switch interface 330 and/or the control circuit 340. Additionally or alternatively, the processor-executable instructions may be stored in a non-transitory computer-readable medium, such as a Secure Digital (SD) card. Although the control circuit 340 and the current source 338 are depicted separate elements, it will be understood that alternative implementations are possible in which the control circuit 340 and the current source 338 are integral with one another.

Figure 5:
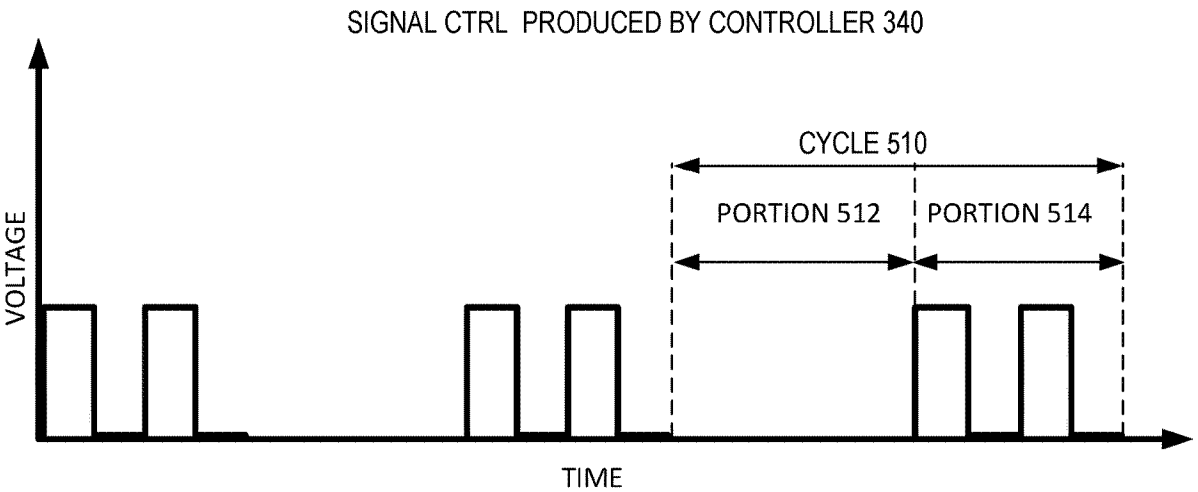
FIG. 5 is a graph of a control signal used to control the operation of a current source in the dimmer switch interface of the illumination system of FIG. 3, according to aspects of the disclosure.

As illustrated in FIG. 5, the control signal CTRL may be a DC square wave having a cycle 510. Each cycle 510 may have a portion 512 in which the signal CTRL has a first duty cycle, and a portion 514 in which the signal CTRL has a second duty cycle that is greater than the first duty cycle. For example, in some implementations, the first duty cycle may be 0% and the second duty cycle may be 50%. In some implementations, each portion 512 of the control signal CTRL may have the same duration as each portion 412 of the current signal S1. Additionally or alternatively, in some implementations, each portion 514 of the control signal CTRL may have the same duration as each portion of the 414 of the current signal S1. The manner in which the control signal CTRL is used to generate the current signal S1 is discussed further below with respect to FIG. 6.

Figure 6:
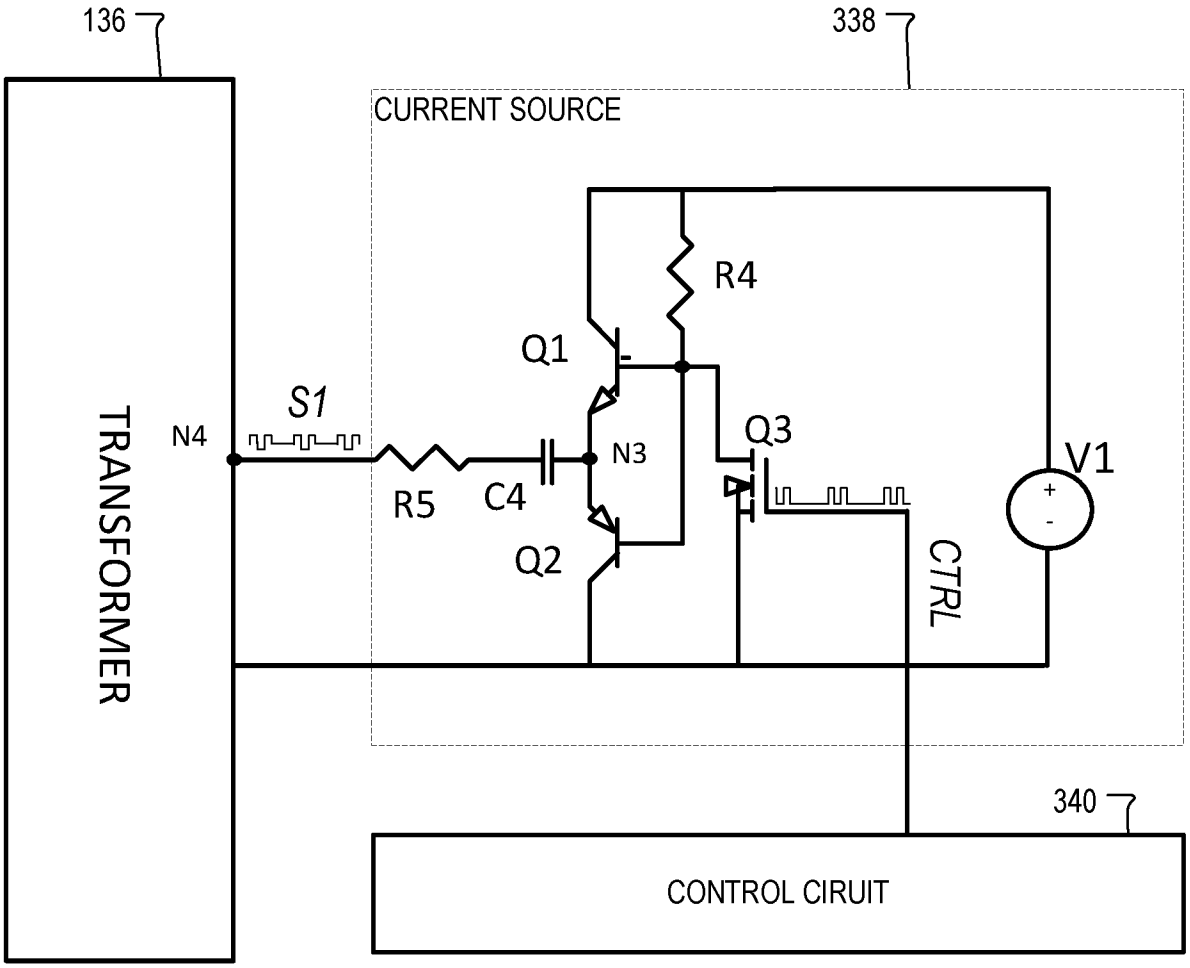
FIG. 6 is a circuit diagram of an example of a current source that can be utilized in the dimmer switch interface of the illumination system of FIG. 3, according to aspects of the disclosure.

FIG. 6 is a diagram illustrating the internal structure of the current source 338 in further detail, according to aspects of the disclosure. As illustrated, the current source 338 may include a DC voltage source V1 and a Metal Oxide Semiconductor Field-Effect Transistor (MOSFET) Q3. The control signal CTRL, which is generated by the control circuit 340, may be applied at the gate of MOSFET Q3. The drain of MOSFET Q3 may be coupled to the respective bases of an NPN transistor Q1 and a PNP transistor Q2. Moreover, the collector of transistor Q1 may be coupled to the positive terminal of voltage source V1 (e.g., +12V), and the collector of transistor Q2 may be coupled to the negative terminal of the voltage source V1 (e.g., 0V). The emitters of transistors Q1 and Q2 may be coupled to one another at node N3. A resistor R5 and a capacitor C4 may be coupled in series to the node N3, as shown.

MOSFET Q3 may be switched on when the signal CTRL is high and switched off when the signal CTRL is low. When MOSFET Q3 is switched off, resistor R4 may forward-bias NPN transistor Q1 and reverse-bias PNP transistor Q2, turning on NPN transistor Q1 and tuning off PNP transistor Q2. When transistor Q1 is turned on and the PNP transistor Q2 is turned off, a high voltage close to the positive terminal voltage of V1 (e.g., +12V) may appear at the node N3, as a result of the electrical path spanning between the positive terminal of the voltage source V1 and node N3 becoming closed. When MOSFET Q3 is switched on, the common base of transistors Q1 and Q2 is pulled down, turning off NPN transistor Q1 and turning on PNP transistor Q2. When transistor Q1 is turned off and the PNP transistor Q2 is turned on, a low voltage close to the negative terminal voltage of V1 (e.g., 0V) may appear at the node N3, as a result of the electrical path spanning between the negative terminal of the voltage source V1 and node N3 becoming closed. In other words, by applying the signal CTRL at the gate of MOSFET Q3 gate, the control circuit 340 may cause a square wave DC voltage at the frequency of the control signal CTRL to appear at the node N3. Capacitor C4 may block the DC component of the DC square wave, turning it into a square AC voltage wave.

According to the example discussed with respect to FIGS. 3-6, the current source 338 may be configured to power the transformer 336 with intermittent current at all times. However, alternative implementations are possible, in which the current source 338 is configured to supply the transformer 336 with intermittent current only when the dimmer switch 310 is in standby mode. In such instances, when the dimmer switch 310 is not in standby mode, the current source 338 may be configured to supply the transformer 336 with continuous current.

According to aspects of the disclosure, the dimmer switch 310 may be in standby mode when it generates a voltage signal (e.g., 0V, 10V, etc.) which causes the driver 322 to turn off the light source 324 completely (e.g., by cutting the supply of current to the light source 324). Additionally or alternatively, the dimmer switch 310 may be considered to be in standby mode when it generates a voltage signal that is less than (or greater than) a predetermined threshold. For example, a manually operated dimmer switch may be in standby mode when the knob on the dimmer switch is turned all the way in one direction.

According to aspects of the disclosure, being able to supply the transformer 336 with intermittent current when the dimmer switch 310 is in standby mode may help improve the energy efficiency of the lighting system 300. For example, in some implementations, switching the transformer 336 with an intermittent current supply with a duty cycle of 10% may reduce the power consumption by 90%. This reduction may be significant in jurisdictions where the illumination system 300 is required to comply with laws and regulations that impose stringent standby power limits on illumination systems.

Figure 7:
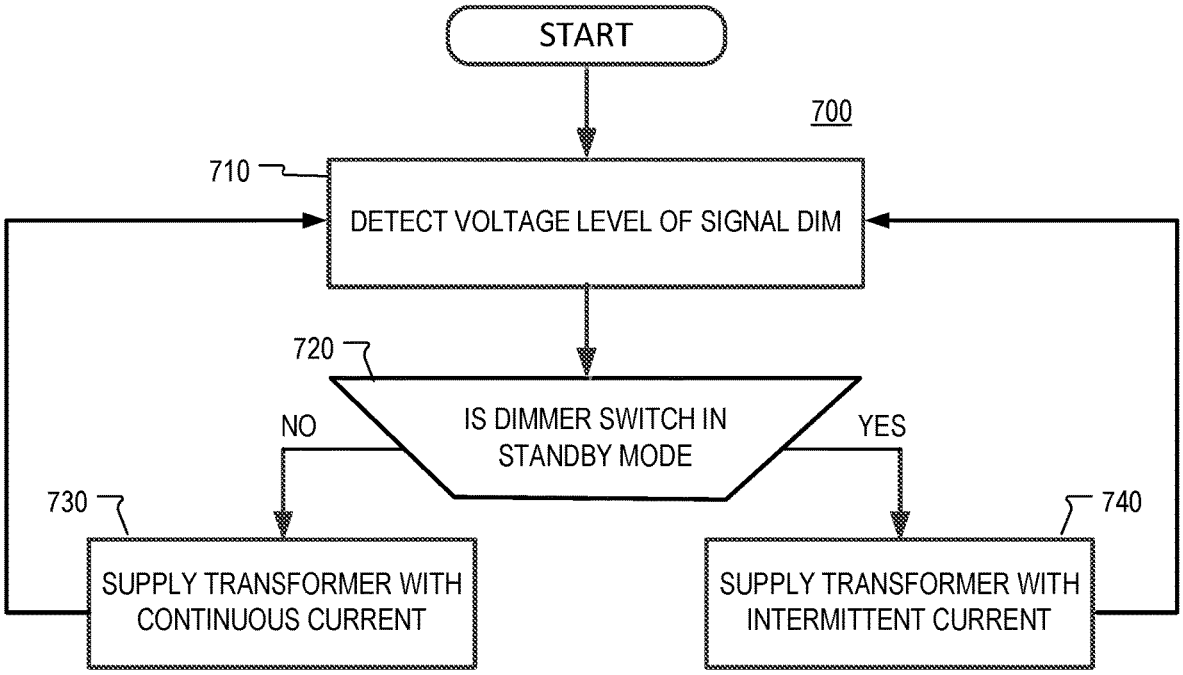
FIG. 7 is a flowchart of an example of a process performed by a controller that is part of the dimmer switch interface of the illumination system of FIG. 3, according to aspects of the disclosure.

FIG. 7 is a flowchart of an example of a process 700 for selectively switching the transformer with an intermittent current supply when the dimmer switch 310 is put in standby mode, according to aspects of the disclosure.

At step 710, the control circuit 340 detects the voltage level of the signal DIM. In some implementations, the control circuit 340 may detect the voltage level of the signal DIM by using an analog-to-digital converter to sample the signal DIM.

At step 720, the control circuit 340 detects whether dimmer switch 310 is in standby mode based on the level of the signal DIM. In some implementations, the control circuit 340 may compare the level of the signal DIM to a predetermined threshold to detect whether the dimmer switch 310 is in standby mode. According to one particular example, when the level of the signal DIM is below a threshold, the control circuit 340 may detect that the dimmer switch 310 is in standby mode and proceed to step 740. According to the same example, when the level of the signal DIM is above the threshold, the control circuit 340 may detect that the dimmer switch 310 is not in standby mode, and proceed to step 730. Although in the present example the control circuit 340 detects that the dimmer switch 310 is in standby mode when the level of the signal DIM is below a threshold, alternative implementations are possible in which the control circuit 340 detects that the dimmer switch 310 is in standby mode when the level of the signal DIM is above a threshold.

Figure 8:
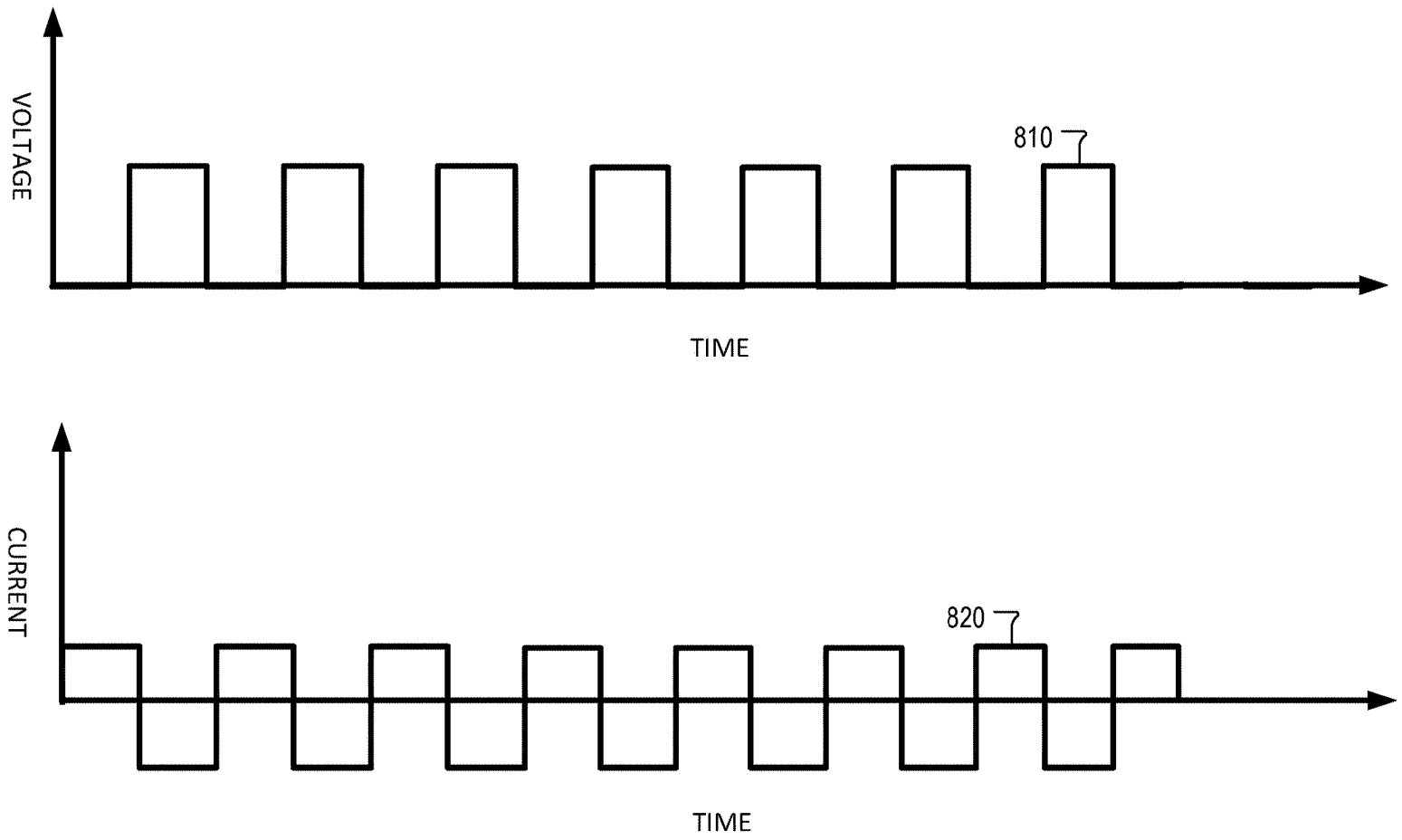
FIG. 8 is a plot illustrating a control signal and a corresponding current signal that can be generated by the current source in the dimmer switch interface of the illumination system of FIG. 3, according to aspects of the disclosure.

At step 730, the control circuit 340 supplies a continuous current to the transformer 336. To supply intermittent current to the transformer 336, the control circuit 340 may provide a first control signal to the current source 338 which causes the current source 338 to output a continuous current. More particularly, the control circuit 340 may generate a control signal 810, which is shown in FIG. 8. As illustrated, the control signal 810 may be a square wave having a constant duty cycle. When the control signal 810 is supplied to the current source 338, the current source 338 may generate a continuous alternating current signal 820. As illustrated in FIG. 8, the current signal 820 may be the same or similar to the signal S0 which is discussed above with respect to FIG. 2.

Figure 9:
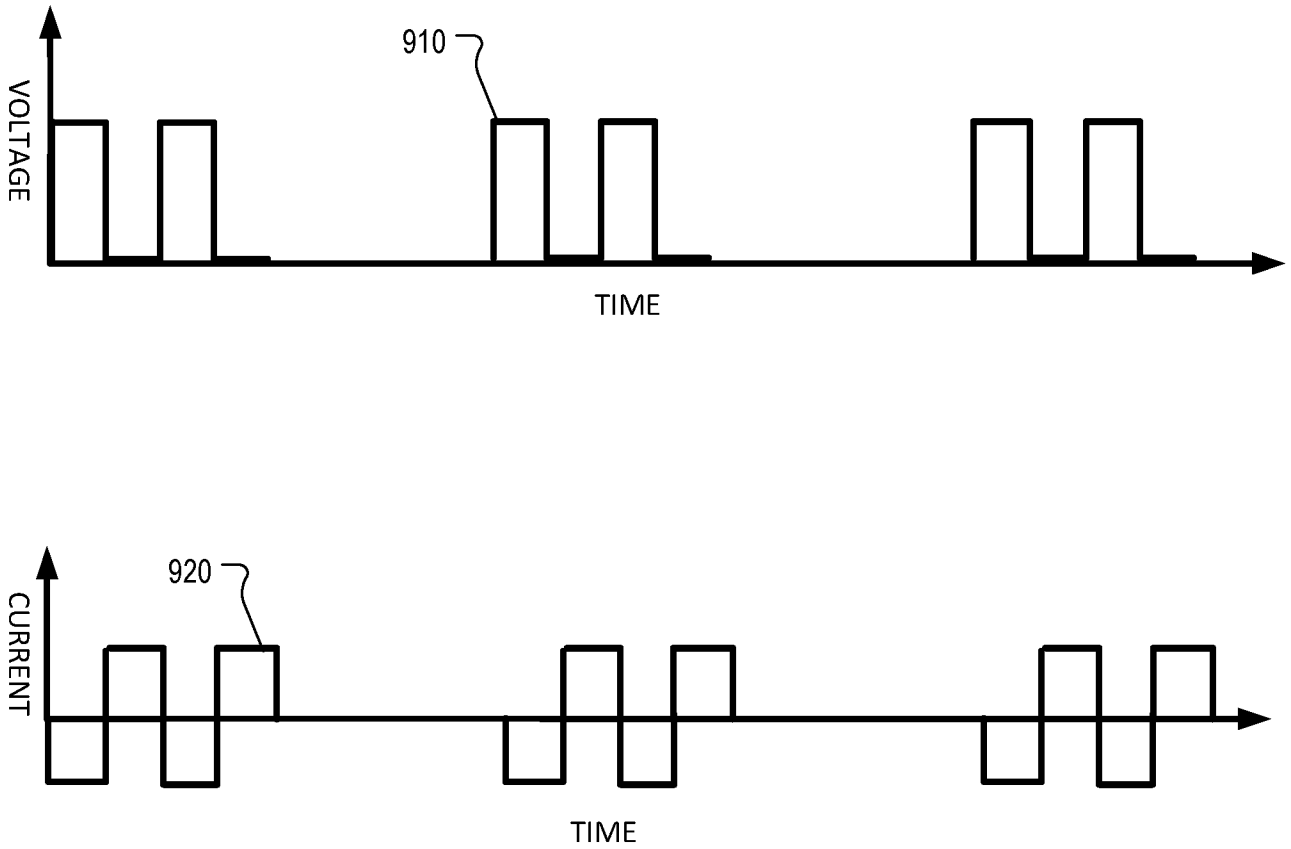
FIG. 9 is a plot illustrating another control signal and another corresponding current signal that can be generated by the current source in the dimmer switch interface of the illumination system of FIG. 3, according to aspects of the disclosure.

At step 740, the control circuit 340 supplies an intermittent current to the transformer 336. To supply continuous current to the transformer 336, the control circuit 340 may provide a second control signal to the current source 338 which causes the current source to output an intermittent current. More particularly, the control circuit 340 may supply the current source 338 with a control signal 910, which is shown in FIG. 9. As illustrated, the control signal 910 may be the same or similar to the control signal CTRL which is discussed above with respect to FIGS. 3-6. When the current source 338 is supplied with the control signal 910, the current source 338 may output to the transformer 336 an intermittent alternating current signal 920, which is also shown in FIG. 9. As illustrated, the alternating current signal 920 may be the same or similar to the signal 51, which is discussed above with respect to FIGS. 3-6.

FIGS. 1-9 are provided as an example only. At least some of the elements discussed with respect to these figures can be arranged in different order, combined, and/or altogether omitted. For example, although in the example of FIG. 6, the transistors Q1 and Q2 are switched by a MOSFET transistors, alternative implementations are possible in which any other suitable type of switching devices is used instead, such as a solid-state relay, a PMOS transistor, etc. Furthermore, although in the present example, PNP and NPN transistors are used to close different electrical paths between voltage source V1 of the current source 338, alternative implementations are possible in which any other suitable type of switching device is used instead, such as a solid-state relay, a PMOS transistor, etc. The voltage source V1 may include any suitable type of voltage. For example, the voltage source may be a power connector. As another example, the voltage source may be a power adapter configured to convert AC mains voltage to DC voltage. Although the dimmer switch interface 330 and the driver 322 are represented as separate elements, it will be understood that in practice the dimmer switch interface 330 and the driver 322 may often be integral with one another. It will be understood that the provision of the examples described herein, as well as clauses phrased as "such as," "e.g.", "including", "in some aspects," "in some implementations," and the like should not be interpreted as limiting the disclosed subject matter to the specific examples.

Having described the invention in detail, those skilled in the art will appreciate that, given the present disclosure, modifications may be made to the invention without departing from the spirit of the inventive concepts described herein. Therefore, it is not intended that the scope of the invention be limited to the specific embodiments illustrated and described.

What is being claimed is:

1. A method of operating a dimmer switch interface, the method comprising:

detecting a voltage level of a dimmer signal;

comparing the voltage level of the dimmer signal with a threshold;

in response to determining that the voltage level of the dimmer signal is below the threshold, supplying an intermittent current signal to a transformer, the intermittent current signal cycling between a first portion having zero current and a second portion having an alternating current; and in response to determining that the voltage level of the dimmer signal is above the threshold, maintaining the transformer in an ON state by supplying the transformer with a continuous alternating current having opposite alternating polarity.

2. The method of claim 1, wherein the supplying the transformer with the intermittent current signal comprises turning off the transformer during the first portion of the intermittent current signal.

3. The method of claim 1, wherein the first portion of the intermittent current signal is longer than the second portion of the intermittent current signal.

4. The method of claim 1, wherein the intermittent current signal is a pulse width modulation (PWM) signal, and the method further comprises generating the PWM signal by intermittently changing a duty cycle of the PWM signal.

5. The method of claim 4, wherein the generating the PWM signal further comprises switching the duty cycle of the PWM signal to a first value during the first portion and switching the duty cycle of the PWM signal to a second value during the second portion.

6. The method of claim 1, further comprising determining that the dimmer switch interface is in a standby mode when the voltage level of the dimmer signal is below the threshold.

7. The method of claim 1, further comprising providing the dimmer signal to a light emitting diode (LED) device driver.

8. The method of claim 1, wherein the dimmer signal is an output of the dimmer switch interface, the method further comprising:

generating, by a control circuit, a control signal for a current source; and generating, by the current source, the intermittent current signal based on the control signal.

9. The method of claim 8, wherein the control signal comprises a first control signal portion having a first duty cycle, and a second control signal portion having a second duty cycle greater than the first duty cycle.

10. A method of operating a dimmer switch interface, the method comprising:

detecting a voltage level of a dimmer signal for controlling a light emitting diode (LED) device;

comparing the voltage level of the dimmer signal with a threshold;

supplying a transformer with an intermittent current in response to determining that the voltage level of the dimmer signal is below the threshold, the intermittent current cycling between first portion having zero current and a second portion having an alternating current; and supplying the transformer with a continuous current in response to determining that the voltage level of the dimmer signal is above the threshold, the continuous current having opposite alternating polarity.

11. The method of claim 10, wherein the first portion of the intermittent current is longer than the second portion of the intermittent current.

12. The method of claim 10, further comprising determining that the dimmer switch interface is in a standby mode when the voltage level of the dimmer signal is below the threshold.

13. The method of claim 10, wherein a duty cycle of the second portion is greater than a duty cycle of the first portion.

14. The method of claim 13, wherein the first duty cycle is 0%.

15. The method of claim 10, wherein the transformer is one of switched off or operated in a low power consumption mode when the voltage level of the dimmer signal is below the threshold.

16. The method of claim 10, wherein the dimmer signal is an output of the dimmer switch interface, the method further comprising:

generating, by a control circuit, a control signal for a current source; and generating, by the current source, the intermittent current based on the control signal.

17. The method of claim 16, wherein the control signal comprises a first control signal portion having a first duty cycle, and a second control signal portion having a second duty cycle greater than the first duty cycle.

18. The method of claim 10, wherein the intermittent current is a pulse width modulation (PWM) signal, and the method further comprises generating the PWM signal by intermittently changing a duty cycle of the PWM signal.

* * * * *